United States Patent [19]

Sobel et al.

[11] 4,349,624

[45] Sep. 14, 1982

[54] PHOTOGRAPHIC SILVER HALIDE MATERIAL

[75] Inventors: Johannes Sobel; Wolfgang Himmelmann, both of Leverkusen; Peter Bergthaller, Cologne, all of Fed. Rep. of Germany

[73] Assignee: Agfa-Gevaert Aktiengesellschaft, Leverkusen, Fed. Rep. of Germany

[21] Appl. No.: 201,210

[22] Filed: Oct. 27, 1980

[30] Foreign Application Priority Data

Oct. 30, 1979 [DE] Fed. Rep. of Germany ..... 2943806

[51] Int. Cl.[3] ..... G03C 1/30

[52] U.S. Cl. ..... 430/622; 260/117; 106/125

[58] Field of Search ..... 430/621-626; 260/117; 106/125

[56] References Cited

U.S. PATENT DOCUMENTS 3,689,274 9/1972 Sobel et al. ..... 430/622

4,142,897 3/1979 Habu et al. ..... 430/624

*Primary Examiner*—Won H. Louie, Jr.

*Attorney, Agent, or Firm*—Connolly and Hutz

[57] ABSTRACT

At least one gelatin-containing layer of a photographic silver halide material is hardened with a reaction product of two compounds corresponding to the formulae $$R(SO_2{-}CH{=}CH_2)_n \qquad (A)$$

in which R is an n-functional aliphatic, aromatic, cycloalkyl or heterocyclic group and n is an integer of from 3 to 6 and

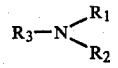

(B)

in which $R_1$ and $R_2$ may be the same or different and represent hydrogen or a lower alkyl group, $R_3$ is an alkyl group, an aminoalkyl group a substituted or unsubstituted aromatic group, a substituted or unsubstituted 5- or 6-membered heterocyclic ring which may be attached to the N-atom of (B) either directly or through a carbon-containing group, or $R_2$ and $R_3$ together represent the atoms required to complete a heterocyclic ring system.

6 Claims, No Drawings

PHOTOGRAPHIC SILVER HALIDE MATERIAL

This invention relates to a photosensitive photographic silver halide material the gelatin layers of which have been hardened with a compound containing vinyl sulphonyl groups.

Numerous substances have already been described as hardeners for proteins and, in particular, for gelatin. They include, for example, metal salts, such as chromium, aluminium or zirconium salts, aldehydes and halogen-containing aldehyde compounds, particularly formaldehyde, dialdehydes and monochloric acid, 1,2- and 1,4-diketones, such as cyclohexane-1,2-dione quinones and chlorides of dibasic organic acids, the anhydrides of tetracarboxylic acids, compounds containing several reactive vinyl groups such as vinyl sulfones, acrylamides, compounds containing at least two readily cleavable, heterocyclic 3-membered rings, such as ethylene oxide and ethylene imine, polyfunctional methane sulfonic acid esters and bis-α-chloroacyl amido compounds.

High molecular weight hardeners, such as for example polyacrolein and its derivatives or copolymers and alginic acid derivatives, have recently become known, being used specifically as hardeners for photographic layers.

However, the use of the compounds referred to above for photographic purposes involves a number of serious disadvantages. Some of these compounds are photographically active and, for this reason, are unsuitable for hardening photographic materials, whilst other adversely affect the physical properties, for example the brittleness, of gelatin layers to such an extent that they cannot be used. Others cause discoloration or a change in the pH-value during the hardening reaction. In addition, it is particularly important in the hardening of photographic layers that hardening should reach its maximum as soon as possible after drying so that the permeability to the developer solution of the material to be hardened is not continually changed, as for example in the case of mucochloric acid or formaldehyde.

In certain cases, crosslinking agents for gelatin also have a damaging effect on the skin, as for example in the case of ethylene imine compounds, so that their use is not advisable for physiological reasons.

It is also known that trichlorotriazine, hydroxy dichlorotriazine and dichloroamino triazines can be used as hardeners. The disadvantage of hardeners such as these lies in their relatively high vapour pressure, in the fact that hydrochloric acid is given off during hardening and in the physiological effect of these compounds. Watersoluble derivatives which contain carboxyl and sulfonic acid groups and which are obtained by reacting cyanuric chloride with one mole of diaminoalkyl or diaminoaryl sulfonic acid or carboxylic acid are not attended by these disadvantages and, for this reason, have recently been proposed as hardeners. However, they are of limited use in practice because, on account of their good solubility, they decompose on standing in aqueous solutions and, as a result, soon lose their effectiveness.

Finally, a very important requirement which any hardener for photographic gelatin-containing layers has to satisfy both in regard to production and also in regard to processing is that even the onset of the crosslinking reaction should be determinable within certain limits, for example through the choice of the drying temperature or the pH-value.

Other known hardeners for photographic gelatin layers are compounds containing two or more acrylic acid amino groups in the molecule, N,N',N''-tris-acrylyl hydrotriazine or methylene-bis-acrylamide.

Although the hardening of the compounds is good after a while, the compounds are sparingly soluble in water which can give rise to irregularities in hardening within the layer.

Particular problems arise in the increasingly used high-speed processing of photographic, particularly color photographic, materials which imposes increased demands on the mechanical properties and swelling behaviour of the materials. In addition, difficulties arise from the need to produce increasingly thinner photographic layers. Attempts have been made to solve these problems by using various hardeners. The known hardeners have either caused new difficulties or have simply proved to be unsuitable. Hardeners such as these include the many known hardeners containing vinyl sulfone groups, of which divinyl sulfone (German Pat. No. 872,153) is one of the most well known. The use of divinyl sulfone is precluded by its toxicity.

In addition, German Pat. No. 1,100,942 discloses aromatic vinyl sulfone compounds whilst German Offenlegungsschrift No. 1,547,733 describes heterocylic vinyl sulfone compounds containing nitrogen or oxygen as heteroatoms. Finally, German Pat. No. 1,808,685 and German Offenlegungsschrift No. 2,348,194 describe bis-vinyl sulfonyl alkyl compounds as hardeners.

The known vinyl sulfone compounds have proved to be unfavourable in many respects as hardeners. They are either inadequately soluble in water require particular measures to make it possible for them to be used in photographic gelatin layers or, alternatively, they adversely affect the drying behaviour of the layers. Others of these compounds increase the viscosity of the casting compositions to such an extent that the processing of the casting compositions into layers is disturbed. Another effect of hardeners of the vinyl sulfone type, particularly in color photographic recording materials is that they cause photographic additives to migrate from one layer to another, resulting in changes both in color and in photographic properties.

Finally, German Offenlegungsschrift No. 2,635,518 describes as hardeners reaction products obtained in reactions of compounds containing at least three vinyl sulfonyl groups in the molecule with compounds containing a water-soluble group and a group which is capable of reacting with a vinyl sulfonyl group. Anionic vinyl sulfonyl compounds are formed in this way. However, these compounds are attended by disadvantages. In gelatin-containing photographic layers, they show pronounced after-hardening, in other words they only develop their optimal effect after prolonged storage of the material. The result of this is that the swelling of the layers in water decreases with increasing storage time, in consequence of which the sensitometric data of the material vary continually. In addition, viscosity increases with increasing digestion time after the addition of the known compounds to the gelatin-containing silver halide emulsions, particularly at pH-values of the order of 7, with the result that the emulsions can no longer be cast without faults.

An object of the present invention is to provide a hardener for photographic gelatin which is sufficiently soluble in water for this purpose, rapidly develops its optimal hardening effect and does not have any tendency towards troublesome after-hardening.

According to the invention, this object is substantially by a photosensitive photographic silver halide material which consists of a support layer and, applied thereto, at least one gelatin-containing layer hardened with a compound containing vinyl sulfonyl groups and which is characterised in that the hardening compound is the reaction product, containing at least two free vinyl sulfonyl groups in the molecule, of two compounds which correspond to the following general formulae:

$$R(SO_2-CH=CH_2)_n \qquad (A)$$

in which

R represents an n-functional aliphatic, hydrocarbon radical which may be substituted, an n-functional, aromatic radical which may be substituted, for example a radical derived from benzene, an n-functional cycloalkyl radical which may be substituted, for example a cyclohexyl radical, or an n-functional heterocyclic radical which may be substituted, for example a hexahydrotriazine radical, and n is an integer of from 3 to 6:

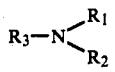

(B)

in which:

$R_1$ and $R_2$ which may be the same or different represent a hydrogen atom or an alkyl group, such as methyl or ethyl, $R_2$ has the same meaning as $R_1$, and $R_3$ is an alkyl group containing from 2 to 7 carbon atoms, an aminoalkyl group containing from 2 to 6 carbon atoms, a cycloaliphatic radical which may be substituted, for example cyclohexyl, an aromatic radical which may be substituted, for example phenyl, or a 5-membered or 6-membered heterocyclic ring which may be attached to the nitrogen atom of the compound (B) either directly or through a carbon-containing group, such as the groups

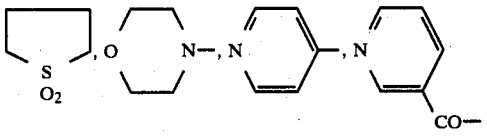

$R_2$ and $R_3$ may together represent the atoms required to complete a heterocyclic ring system which, in addition to the nitrogen atom, may contain an oxygen atom or another nitrogen atom.

The following compounds are examples of suitable compounds corresponding to formula (A):

A/1 $C(CH_2SO_2CH=CH_2)_4$

A/2 $C(CH_2OCH_2SO_2CH=CH_2)_4$

A/3 $C_2H_5C(CH_2SO_2CH=CH_2)_3$

A/4 $CH_3C(CH_2OCH_2SO_2CH=CH_2)_3$

A/5 $C_8H_{17}C(CH_2SO_2CH=CH_2)_3$

-continued

A/6 $(CH_2=CHSO_2CH_2)_2CHCH(CH_2SO_2CH=CH_2)_2$

A/7 $(CH_2=CHSO_2CH_2)_3CCH_2OCH_2C(CH_2SO_2CH=CH_2)_3$

A/8 $(CH_2=CHSO_2CH_2)_3CCH_2SO_2CH_2CH_2Cl$

A/9 $CH_2=CHSO_2CH_2)_3CCH_2Br$

A/10 $N(CH_2CH_2OCH_2SO_2CH=CH_2)_3$

A/11 $CH_2=CHSO_2CH_2CH(SO_2CH=CH_2)CH_2SO_2CH=CH_2$

A/12

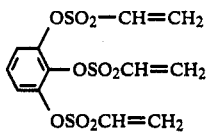

A/13

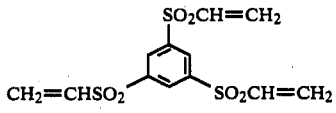

A/14

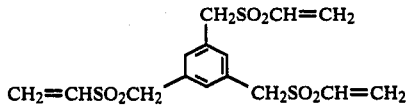

A/15

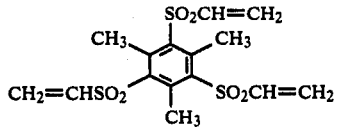

A/16

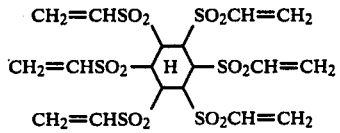

A/17

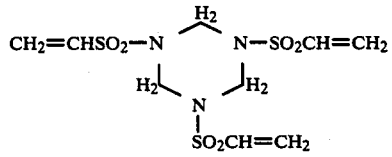

A/18

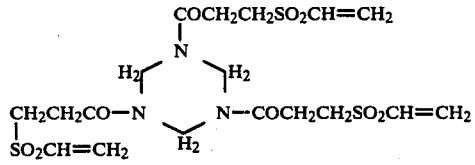

So far as the production of the compounds corresponding to formula (A) is concerned, reference is made to the following publications. Processes suitable for producing aromatic vinyl sulfone compounds are described in German Pat. No. 1,100,942. Heterocyclic vinyl sulfonyl alkyl compounds may be produced by the method described in German Offenlegungsschrift No. 1,547,733. Sulfonamide esters may be produced in accordance with German Offenlegungsschrifts Nos. 1,094,735 and 1,178,071 or British Pat. No. 1,071,298. Information on the production of vinyl sulfonyl alkanes can be found in German Offenlegungsschrift No.

2,348,194. Finally, the production of tris-[β-(vinyl sulfonyl)-propionyl]-hexahydrotriazine is described in Published Japanese patent application No. 74/46 495. The compounds of formula (A) suitable for forming the hardeners according to the invention may be obtained by the processes described in these publications.

The following compounds (B) for example represent suitable amines which may be reacted with the compounds (A) containing vinyl sulfonyl groups in the form of amine salts, such as for example chlorides or sulfates.

B1 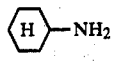

B/2 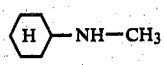

B/3 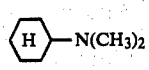

B/4 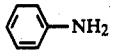

B/5 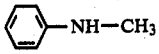

B/6 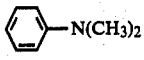

B/7 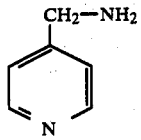

B/8 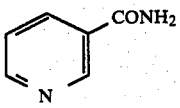

B/9 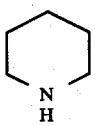

B/10 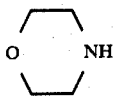

B/11 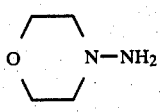

B/12 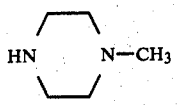

B/13 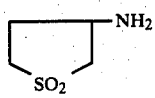

-continued

B/14 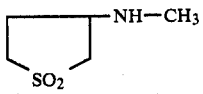

B/15 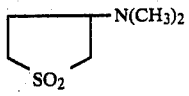

B/16 $C_3H_7—NH_2$

B/17 $NH_2—CH_2—CH_2—NH_2$

B/18 $NH_2—(CH_2)_6—NH_2$

B/19 $NH_2—(CH_2)_3—N(CH_3)_2$

The amines corresponding to formula (B) are standard commercial products.

The hardeners according to the invention, hereinafter referred to as compounds (C), contain at least two vinyl sulfonyl groups and at least one group obtained by reacting a vinyl sulfonyl group with an amine (compounds (B)) in the molecule. The reaction products are soluble in water and have excellent crosslinking properties for gelatin-containing layers.

The compounds (C) are obtained by reacting solutions of compounds (A) with solutions of compounds (B) in the form of their amine salts or as free amines. In the latter case, the amines are converted into the amine salts on completion of the reaction, for example by the addition of appropriate quantities of an acid, such as hydrochloric or sulfuric acid.

The molar ratios between the vinyl sulphonyl compounds and the amines during the reaction vary depending upon the number of vinyl sulfonyl groups in the compounds (A). Basically, the reaction product contains at least two unreacted vinyl sulfone groups. It is preferred to react one mole of compound (A) with from 0.5 to 1 mole of compound (B).

The reaction products are preferably used in the form in which they are obtained on completion of the reaction, i.e. they do not have to be isolated. However, the reaction products may also be isolated and purified.

The production of the cationic hardeners according to the invention is illustrated by the following Examples.

HARDENER C/1

200 ml of an aqueous solution containing 14 g (0.075 mole) of N-methylaminosulfolan hydrochloride (compound B/14) are added to 43.2 g (0.1 mole) of tetrakis-(vinyl sulfonylmethyl)-methane (compound A/1) in 575 ml of acetone. The mixture was heated for 2 hours to 60° C., subsequently cooled to room temperature and filtered off from a few insoluble substances. An approximately 8% by weight solution was obtained.

HARDENER C/11

50 ml of an aqueous solution containing 3.71 g (0.02 mole) of N-methylaminosulfolan hydrochloride (compound B/14) were added to a solution of 7.1 g (0.02 mole) of tris-vinyl sulfonyl hexahydro-s-triazine (compound A/17) in 100 ml of acetone. The reaction mixture was heated for 4 hours to 60° C. and then cooled to room temperature. An approximately 8% by weight solution was obtained.

HARDENER C/15

50 ml of an aqueous solution containing 2.57 g (0.015 mole) of 3-aminosulfolan hydrochloride (compound (B/12) were added to a solution of 7.8 g (0.02 mole) of pyrogalloltris-vinyl sulfonyl ester (compound A/12) in 100 ml of acetone. The reaction mixture was heated for 3 hours to 60° C. An approximately 8% by weight solution was obtained.

HARDENER C/2

Produced from compounds A/1 and B/7 (molar ratio 1:1).

HARDENER C/3

Produced from compounds A/1 and B/13 (molar ratio 1:0.5).

HARDENER C/4

Produced from compounds A/1 and B/2 (molar ratio 1:1).

HARDENER C/5

Produced from compounds A/1 and B/8 (molar ratio 1:0.8).

HARDENER C/6

Produced from compounds A/1 and B/15 (molar ratio 1:1).

HARDENER C/7

Produced from compounds A/1 and B/10 (molar ratio 1:1).

HARDENER C/8

Produced from compounds A/1 and B/16 (molar ratio 1:0.6).

HARDENER C/9

Produced from compounds A/1 and B/5 (molar ratio 1:1).

HARDENER C/10

Produced from compounds A/1 and B/6 (molar ratio 1:1).

HARDENER C/12

Produced from compounds A/17 and B/9 (molar ratio 1:1).

HARDENER C/13

Produced from compounds A/17 and B/13 (molar ratio 1:0.75).

HARDENER C/14

Produced from compounds A/17 and B/2 (molar ratio (1:1).

HARDENER C/16

Produced from compounds A/12 and B/7 (molar ratio 1:0.75).

HARDENER C/17

Produced from compounds A/12 and B/9 (molar ratio 1:1).

HARDENER C/18

Produced from compounds A/12 and B/14 (molar ratio 1:1).

HARDENER C/19

Produced from compounds A/12 and B/13 (molar ratio 1:0.65).

HARDENER C/20

Produced from compounds A/1 and B/11 (molar ratio 1:0.5).

In general, the cationic compounds according to the invention are used as hardeners in the form in which they are obtained in the production process. However, they may if necessary be used in the form of relatively dilute or relatively concentrated solutions.

The gelatins may be hardened with the hardeners according to the invention by any of the usual methods.

The hardeners are generally incorporated in the casting solutions in a quantity of from 0.01 to 100% by weight and preferably in a quantity of from 0.1 to 10% by weight, based on the dry weight of the gelatin. The time at which the hardeners are added is not critical. However, the hardener is preferably added to silver halide emulsions after chemical ripening. The hardener may of course also be introduced into a layer assembly in the form of a solution by the so-called overcoating process.

In the context of the invention, photographic layers are understood quite generally to be layers of the type used in photographic materials, for example photo-sensitive silver halide emulsion layers. protective layers filter layers, anti-halo layers, backing layers or, quite generally, photographic auxiliary layers.

Photosensitive emulsion layers for which the hardening process according to the invention is particularly suitable are, for example, layers of the type based on non-sensitized emulsions, X-ray emulsions and other spectrally sensitized emulsions. The hardening process according to the invention may also be effectively used for hardening the gelatin layers used for the various photographic black-and-white and color processes, such as negative, positive and diffusion transfer processes or printing processes. The process according to the invention has proved to particularly advantageous for hardening photographic layer assemblies of the type intended for carrying out color-photographic processes, for example those containing emulsion layers with color couplers or emulsion layers intended for treatment with solutions containing color couplers.

The effect of the compounds used in accordance with the invention is not adversely affected by the usual photographic additives. Neither are the hardeners affected by photographically active substances such as, for example, water-soluble and emulsified water-insoluble dye components, stabilizers and sensitizers. They also have no adverse effect upon the photosensitive silver halide emulsions.

The photosensitive constituents present in the emulsion layers may be formed by any known silver halides, such as for example silver chloride, silver iodide, silver bromide, silver iodobromide, silver chlorobromide and silver chloroiodobromide. The emulsions may be chemically sensitized with nobel metal compounds, for example with compounds of ruthenium, rhodium, palladium, iridium, platinum, gold, ammonium chloropalladate, potassium chloroplatinate, potassium chloropalladite or potassium chloroaurate. In addition they may contain special sensitizers of sulphur compounds, tin(II)salts, polyamines or polyalkylene oxide compounds. The emulsions may also be optically sensitized with cyanine dyes, merocyanine dyes and mixed cyanine dyes.

Finally, the emulsions may contain a variety of couplers, for example colorless couplers, colored couplers, stabilizers, such as mercury compounds, triazole compounds, aza-indene compounds, benzothiazolium compounds or zinc compounds, wetting agents, such as dihydroxy alkanes, agents which improve the film-forming properties, for example the water-dispersible, particulate high polymers obtained in the emulsion polymerization of alkyl acrylate or alkyl merthacrylate/acrylic acid or methacrylic acid copolymers, styrene/maleic acid copolymers or stryrene/maleic acid anhydride semialkyl ester copolymers, coating aids, such as polyethylene glycol lauryl ether, and a variety of other photographic additives.

The hardeners according to the invention do not have the property of suddenly developing their hardening effect nor do they have any tendency towards over-hardening gelatin layers. Both properties represent a significant advantage so far as the production process for photographic materials is concerned.

EXAMPLE 1

The following layers are successively applied to a cellulose triacetate support layer provided with a subbing adhesive layer:

1. An anti-halation layer containing 4 g of gelatin and 0.7 g of colloidal black silver per square meter,
2. a 6μ thick red-sensitive layer containing per square meter 35 mMole of silver halide (95% of AgBr, 5% of AgI), 4 mMole of a cyan coupler corresponding to the following formula

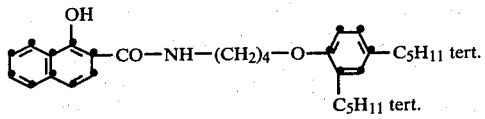

and 6 g of gelatin, 3. a 0.5μ thick gelatin intermediate layer,
4. a 6μ thick green-sensitive layer containing per square meter 30 mMole of silver halide (5% of AgI, 95% of AgBr), 1.3 mMole of a magenta coupler corresponding to the following formula

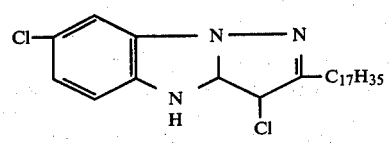

and 5 g of gelatin.

5. a 0.5μ thick gelatin intermediate layer,
6. a yellow filter layer containing 1.5 g of gelatin and 0.2 g of colloidal yellow silver per square meter,
7. a 6μ thick blue-sensitive layer containing per square meter 13 mMole of silver halide (95% of AgBr, 5% of AgI), 2 mMole of a yellow coupler corresponding to the following formula

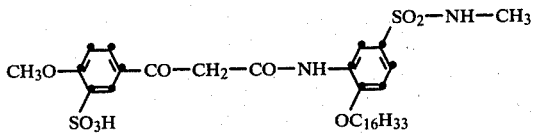

and 5 g of gelatin, and 8. a 1μ thick gelatin protective layer.

The layer assembly is then dried.

The photographic film thus produced is used as a comparison material in the following.

The production of the film is repeated, one of the hardeners C/1, C/2, C/3, C/4, C/11 and C/15 being added to the individual layers per film sample in a quantity of 0.02 g per gram of gelatin.

The samples hardened in the manner described are then tested by the methods described below. The results are set out in Table 1.

The hardening of photographic materials is determined by means of the melting point of the layers which may be determined as follows:

The layer assembly cast onto a support is semi-immersed in water continuously heated to 100° C. The temperature at which the layer separates from the substrate (streak formation) is termed the melting point. In no case do unhardened protein or colour layers show an increase in melting point in this measuring process. Under these conditions, the melting point is in the range from 30° to 35° C.

To determine water uptake, the test specimen is developed as a black sheet in a standard color developing process and, after the final bath, is weighed after the surplus water has been stripped off. The test specimen is then dried and re-weighed. The difference when converted to 1 square meter from the surface area of the test specimen, represents the water uptake per square meter.

Swelling is measured gravimetrically after a test strip has been treated for 10 minutes in distilled water at 22° C. It is characterised by the swelling factor:

$$\frac{\text{Layer weight wet}}{\text{Layer weight dry}} = \text{swelling factor}$$

To determine wet scratch resistance, a metal point of defined size is moved over the wet layer and subjected to an increasing load. The wet scratch resistance is represented by that load under which the point leaves a visible trace on the layer. A high load corresponds to a high wet scratch resistance.

TABLE 1

| | | After storage of the material for 36 hours at 57° C./34% relative AH | | |
|---|---|---|---|---|
| Sample No. | Hardener | melting point of the layer | swelling factor | wet scratch resistance (p) |
| 1 | C/1 | 100° C. | 3.9 | 400 |
| 2 | C/2 | 100° C. | 3.5 | 250 |
| 3 | C/3 | 100° C. | 4.2 | 300 |
| 4 | C/4 | 100° C. | 3.4 | 300 |
| 5 | C/11 | 100° C. | 4.1 | 250 |
| 6 | C/15 | 100° C. | 4.4 | 250 |
| Comparison (unhardened) | — | 40° C. | 6–8 | <200 |

| | | After storage of the material for 7 days at 36° C./80% relative AH | |
|---|---|---|---|
| Sample No. | Hardener | swelling factor | wet scratch resistance (p) |
| 1 | C/1 | 3.0 | 600 |
| 2 | C/2 | 3.1 | 550 |
| 3 | C/3 | 3.5 | 450 |
| 4 | C/4 | 3.0 | 600 |
| 5 | C/11 | 3.5 | 500 |
| 6 | C/15 | 3.5 | 450 |
| Comparison (unhardened) | — | 6–8 | <200 |

No changes were observed in the photographic properties of the samples, such as sensitivity, fogging and gradation. The swelling values changed only slightly after short-term and long-term storage. The after-hardening of the samples was correspondly minimal.

As the results of Table 1 show, excellent hardening is obtained with the hardeners according to the invention. The melting points of the layers are above 100° C. and their wet scratch resistance values are so high that they can be processed in machines. The viscosities of the casting solutions show no increase after digestion for 1 hour at 40° C. Neither is the onset of the hardening effect sudden, as can be seen from the increase in the crosslinking of the layers after prolonged storage at 30° C./80% relative air humidity.

EXAMPLE 2

A color photographic material is prepared by successively applying the following layers to a paper support lined with polyethylene and provided with an subbing layer, the emulsion layers containing the usual additions of wetting agents, stabilizers etc.:

1. As undercoat, a 4μ thick blue-sensitive silver chlorobromide emulsion layer containing per kg of emulsion 25.4 g of silver (88% of AgBr, 12% of AgCl), 80% of gelatin and 34 g of the yellow component

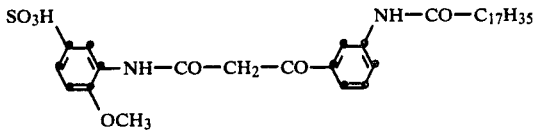

2. as intermediate layer a 1μ thick gelatin layer;
3. as middle coat, a 4μ thick green-sensitive silver chloro bromide emulsion layer containing per kg of emulsion 22 g of silver (77% of AgCl, 23% of AgBr), 80 g of gelatin and 13 g of the magenta component

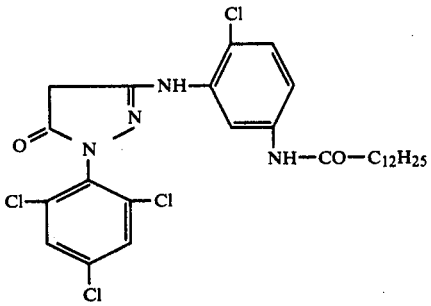

4. a 1μ thick intermediate layer as described under 2,
5. as topcoat a 4μ thick red-sensitive silver chloro bromide emulsion layer containing per kg of emulsion 23 g of silver (80% of AgCl, 20% of AgBr), 80 g of gelatin and 15.6 g of the cyan component

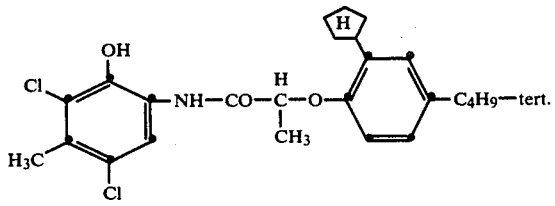

6. a 1μ thick protective layer of gelatin.

2 g of the hardener per 100 g of gelatin are added to each of the six casting solutions. The casting solutions are then cast in the usual way within a few seconds. As in Example 1, the materials are stored for various periods under various climatic conditions. Hardening is then determined by measuring the melting point, the swelling factor and the wet scratch resistance.

TABLE 2

| Hardener | After storage of the material for 36 hours at 57° C./34% relative AH: layer melting point | swelling factor | wet scratch resistance (p) |
|---|---|---|---|
| 2 g of compound C/1 (per 100 g of gelatin) | 100° C. | 3.8 | 350 |
| 2 g of compound C/3 | 100° C. | 3.6 | 300 |
| 2 g of compound C/15 | 100° C. | 3.8 | 260 |
| Comparison (no hardener) | 30° C. | >7 | <200 |

TABLE 2-continued

| Hardener | After storage of the material for 7 days at 36° C./80% relative AH: layer melting point | swelling factor | wet scratch resistance (p) | |
|---|---|---|---|---|
| 2 g of compound C/1 (per 100 g of gelatin) | 100° C. | 3.1 | 600 | good adhesion to the polyethylene-lined substrate |
| 2 g of compound C/3 | 100° C. | 3.2 | 550 | good adhesion to the polyethylene-lined substrate |
| 2 g of compound C/15 | 100° C. | 3.4 | 600 | good adhesion to the polyethylene-lined substrate |
| Comparison (no hardener) | 38° C. | >7 | <200 | |

As can be seen from Table 2, an increase in the melting point to beyond 100° C. is obtained after storage for 36 hours at 57° C./34% relative air humidity (AH). Accordingly, the layers can be developed in processing machines at 38° C. without layer separation. The swelling factor decreases from more than 7 to between 3 and 4 and the wet scratch resistance increases to 400 to 600 p. Accordingly, the layers are impossible or virtually impossible to scratch. The layer assemblage adheres very firmly to the polyethylene-lined substrate. There is no evidence of troublesome after-hardening.

EXAMPLE 3

Quantities of 1, 2 and 5 g of the compounds according to the invention per 100 g of gelatin are added in the form of aqueous solutions at pH 6.2 to 100 ml of a photographic silver bromide gelatin emulsion ready for casting (gelatin content 10% by weight). The mixtures are thoroughly stirred, cast onto a prepared cellulose triacetate support by means of a standard casting machine and dried. The usual additions are not changed. Details on the composition of the samples, the various test conditions and, finally, the results are set out in Table 3.

TABLE 3

| Hardener | After storage for 1 day at 22° C. in a tin foil bag: layer melting point | swelling factor | wet scratch resistance |
|---|---|---|---|
| Compound C/20 | | | |
| 1 g | 100° C. | 5.1 | 350 |
| 2 g | 100° C. | 4.5 | 350 |
| 5 g | 100° C. | 3.4 | 350 |
| Compound C/8 | | | |
| 1 g | 100° C. | 4.7 | 250 |
| 2 g | 100° C. | 4.1 | 550 |
| 5 g | 100° C. | 3.3 | 400 |
| Compound C/10 | | | |
| 1 g | 100° C. | 5.8 | 200 |
| 2 g | 100° C. | 5.0 | 400 |
| 5 g | 100° C. | 3.7 | 500 |
| Compound C/19 | | | |
| 1 g | 35° C. | — | — |

TABLE 3-continued

| | | | |
|---|---|---|---|
| 2 g | 35° C. | — | — |
| 3 g | 80° C. | — | — |
| Comparison (without hardening) | 36° C. | — | — |

| Hardener | After storage for 36 hours at 57° C./34% relative AH | | |
|---|---|---|---|
| | layer melting point | swelling factor | wet scratch resistance |
| Compound C/20 | | | |
| 1 g | 100° C. | 4.2 | 450 |
| 2 g | 100° C. | 3.8 | 650 |
| 5 g | 100° C. | 2.9 | 700 |
| Compound C/8 | | | |
| 1 g | 100° C. | 3.9 | 300 |
| 2 g | 100° C. | 2.9 | 550 |
| 5 g | 100° C. | 2.9 | 600 |
| Compound C/10 | | | |
| 1 g | 100° C. | 4.3 | 250 |
| 2 g | 100° C. | — | — |
| 5 g | 100° C. | 2.9 | 850 |
| Compound C/19 | | | |
| 1 g | 100° C. | 4.2 | 150 |
| 2 g | 100° C. | 4.0 | 350 |
| 3 g | 100° C. | 3.8 | 400 |
| Comparison (without hardening) | 36° C. | — | — |

| Hardener | After storage for 7 days at 36° C./80% relative AH | | |
|---|---|---|---|
| | layer melting point | swelling factor | wet scratch resistance |
| Compound C/20 | | | |
| 1 g | 100° C. | 3.8 | 500 |
| 2 g | 100° C. | 3.5 | 600 |
| 5 g | 100° C. | 2.3 | 900 |
| Compound C/8 | | | |
| 1 g | 100° C. | 3.8 | 350 |
| 2 g | 100° C. | 3.5 | 600 |
| 5 g | 100° C. | 2.4 | 800 |
| Compound C/10 | | | |
| 1 g | 100° C. | 3.8 | 450 |
| 2 g | 100° C. | — | — |
| 5 g | 100° C. | 2.4 | 900 |
| Compound C/19 | | | |
| 1 g | 100° C. | 3.6 | 450 |
| 2 g | 100° C. | 3.2 | 600 |
| 3 g | 100° C. | 2.6 | 450 |
| Comparison (without hardening) | 38° C. | — | — |

As Table 3 shows, crosslinking increases with increasing amount of hardener, although no over hardening is obtained (this would mean for example swelling factors of less than 2 or wet scratch resistance values of more than 1000). In addition, after-hardening decreases with increasing amount of hardener.

With some of the compounds according to the invention, the layer melting point of 100° C. is obtained after standing for only 1 day at 22° C. in the absence of air, an indication of relatively quick and uniform crosslinking. All the photographic properties remain intact. Fogging and sensitivity remain the same. Adhesion to the substrate is good.

EXAMPLE 4

This Example illustrates the differences in the reaction mechanism of the compounds according to the invention in relation to the known hardeners. The hardeners to be tested were each used in a photographic black-and-white emulsion. The emulsion had the following composition:

25 g of silver (88% of AgBr, 12% of AgCl)
80 g of gelatin
to 1 kg of emulsion

The following known hardeners were used as comparison compounds (VV):

VV1 $C(CH_2—SO_2—CH=CH_2)_4$ corresponding to German Offenlegungsschrift No. 2,545,722

VV2 reaction product 1 mole of $C(CH_2—SO_2—CH=CH_2)_4$ and 1 mole of taurine produced in accordance with German Offenlegungsschrift No. 2,635,518.

Compound C/1 was used as the hardener according to the invention. Quantities of 2% by weight of the hardeners, based on gelatin, were added to the casting solutions. The casting solutions were cast onto a cellulose triacetate support provided with an adhesive layer and dried (layer thickness 10μ).

The hardening properties were measured after various periods of storage under various climatic conditions. The results are set out in Table 4.

TABLE 4

| Hardener | Storage conditions 1 | | Storage conditions 2 | |
|---|---|---|---|---|
| | swelling factor | Wet scratch resistance (p) | swelling factor | Wet scratch resistance (p) |
| VV1 | 4.8 | 200 | 3.5 | 750 |
| VV2 | 3.8 | 300 | 3.5 | 750 |
| C/1 | 3.7 | 500 | 4.0 | 500 |

| Hardener | Storage conditions 3 | | Reduction in maximal density after development |
|---|---|---|---|
| | swelling factor | wet scratch resistance (p) | |
| VV1 | 2.5 | 100 | 15% |
| VV2 | 2.5 | >1000 | 15% |
| C/1 | 3.1 | 550 | 2% |

Storage conditions 1: 36 hours at 22° C. in the absence of moisture (short-term storage)
Storage conditions 2: 36 hours at 57° C./34% relative AH
Storage conditions 3: 7 days at 36° C./80% relative air humidity (long-term storage).

The Tables shows that the comparison samples VV1 and VV2 undergo pronounced after-hardening during long-term storage. The swelling factors are relatively high to begin with and decrease significantly after long-term storage. This reduces the maximal densities of the developed film samples (retarded through-development or reduced silver covering power). Where materials characterised by good through-developability and average hardening after long-term storage are required, it is necessary to use less hardener. In that case, however, the photographic layers undergo pronounced swelling during short-term storage and are hence too soft for practical purposes.

The compound C/1 according to the invention used for comparison hardens the material relatively quickly to a medium degree of hardening and shows only negligible after-hardening in long-term storage. All in all, therefore, a balanced hardening of the photographic material largely unaffected by storage is obtained with the hardeners according to the invention.

We claim:

1. A photographic light-sensitive silver halide material comprising a support and at least a gelatin-containing layer hardened with a reaction product (C) which is an amine salt containing at least 2 vinyl sulfonyl groups and which is obtained by reacting in solution at a temperature ranging from room-temperature to the reflux-temperature of the solution of a compound containing at least 3 vinyl sulfonyl groups in the molecule with an amine or an amine salt, whereby said compound corresponds to the following general formulae:

$$R(SO_2-CH=CH_2)_n \qquad (A)$$

in which:

R represents an n-functional aliphatic hydrocarbon radical which may be substituted, an n-functional aromatic hydrocarbon radical which may be substituted, an n-functional cycloalkyl radical which may be substituted or an n-functional heterocyclic radical which may be substituted and n is an integer of from 3 to 6, and said amine or amine salt corresponds to the following general formulae:

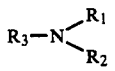

(B)

in the form of the free amine or the corresponding amine salt in which:

$R_1$ and $R_2$ may be the same or different and represent a hydrogen atom or an unsubstituted lower alkyl group, $R_3$ represents an unsubstituted alkyl group, an unsubstituted aminoalkyl group, an unsubstituted cycloaliphatic radical, an unsubstituted aromatic radical or a 5-membered or 6-membered unsubstituted heterocyclic ring which may be attached to the nitrogen atom of compound (B) either directly or through a carbon-containing group, or $R_2$ and $R_3$ together represent the atoms required to complete an unsubstituted heterocyclic ring system which, in addition to nitrogen atom, may contain an oxygen atom or another nitrogen atom.

2. A photosensitive material as claimed in claim 1, characterised in that it is hardened with a reaction product of one of the compounds

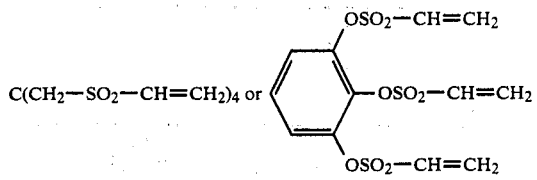

(A)

with one of the compounds

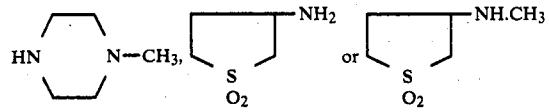

(B)

3. A photosensitive material as claimed in claim 1, characterised in that the hardening compound is the reaction product of one mole of the compound $C(CH_2SO_2CH=CH_2)_4$ and 0.75 mole of the compound

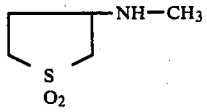

4. A photosensitive material as claimed in claim 1, characterised in that the hardening compound is the reaction product of one mole of the compound $C(CH_2SO_2CH=CH_2)_4$ and 0.5 mole of the compound

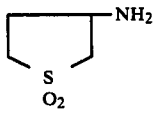

5. A photosensitive material as claimed in any of claims 2, 3 or 4, characterised in that it contains from 0.1 to 10% by weight of the hardening compound, based on the dry weight of the gelatin.

6. A photosensitive material as claimed in claims 2, 3 or 4, characterised in that it is a colour photographic multilayer material.

* * * * *